US008056170B2

(12) United States Patent
Adams et al.

(10) Patent No.: US 8,056,170 B2
(45) Date of Patent: Nov. 15, 2011

(54) PULLING TOOL

(75) Inventors: Robert Adams, Santa Fe Springs, CA (US); Jared Hanlon, Santa Fe Springs, CA (US)

(73) Assignee: Pull'R Holding Company, LLC, Elk Grove Village, IL (US)

( * ) Notice: Subject to any disclaimer, the term of this patent is extended or adjusted under 35 U.S.C. 154(b) by 55 days.

(21) Appl. No.: 12/220,456

(22) Filed: Jul. 23, 2008

(65) Prior Publication Data

US 2009/0008614 A1 Jan. 8, 2009

Related U.S. Application Data

(63) Continuation of application No. 29/254,444, filed on Feb. 23, 2006, now Pat. No. Des. 579,292.

(51) Int. Cl.
*B66F 15/00* (2006.01)
*B25D 1/04* (2006.01)

(52) U.S. Cl. ..... 7/166; 7/147

(58) Field of Classification Search ..... 7/138, 145, 7/166, 169, 146, 147; 81/176.1, 177.1
See application file for complete search history.

(56) References Cited

U.S. PATENT DOCUMENTS

| | | | | | |
|---|---|---|---|---|---|
| 165,671 | A | * | 7/1875 | Hagerty | 7/138 |
| 506,832 | A | * | 10/1893 | Schofield | 7/138 |
| 968,106 | A | * | 8/1910 | Zimmermann | 81/120 |
| D45,761 | S | * | 5/1914 | Miller | D8/76 |
| D53,613 | S | | 7/1919 | Rockwell | |
| 1,422,689 | A | | 7/1922 | Funk | |
| 1,472,517 | A | | 10/1923 | Fry | |
| 1,581,119 | A | * | 4/1926 | Herring | 157/1.3 |
| D70,218 | S | * | 5/1926 | Gilbert | D8/26 |
| 1,584,422 | A | * | 5/1926 | Bate | 81/124.3 |
| 1,596,602 | A | * | 8/1926 | Eagan et al. | 7/145 |
| 1,689,585 | A | * | 10/1928 | Haschart | 81/125.1 |
| 2,148,573 | A | * | 2/1939 | Mulcay | 81/439 |
| 2,300,840 | A | * | 11/1942 | Huxel | 7/158 |
| D138,790 | S | * | 9/1944 | Czekalski | D8/26 |
| 4,224,544 | A | | 9/1980 | McKinnon et al. | |
| 4,597,123 | A | | 7/1986 | Cobe, Jr. | |
| 5,103,520 | A | * | 4/1992 | Mazzo | 7/104 |
| 6,629,684 | B2 | | 10/2003 | Youngren et al. | |
| D507,167 | S | | 7/2005 | Richardson | |
| D518,343 | S | | 4/2006 | Kelleghan | |
| D525,506 | S | | 7/2006 | Downing, Jr. | |
| 2006/0075572 | A1 | * | 4/2006 | Young | 7/138 |
| 2007/0289415 | A1 | * | 12/2007 | Hsieh | 81/177.1 |

OTHER PUBLICATIONS

The Japan Woodworker—Spring-Summer 2002, Google Catalogs [online], [retrieved on Feb. 7, 2007], Retrieved from Google Catalogs using Internet <URL: http://catalogs.google.com/catalogs?vid=0RuOBjdgxgvXw&id=1PcMN4XgxMUC &printsec=frontcover&...

* cited by examiner

*Primary Examiner* — David B Thomas
(74) *Attorney, Agent, or Firm* — Cherskov & Flaynik

(57) ABSTRACT

A multi-function tool having a handle portion and a plurality of structures operable therewith for the performance of a plurality of functions. The multi-function tool allows fast and convenient transition between any of the plurality of functions in order to enable completion of jobs or tasks requiring such functions without acquisition, storage, and/or maintenance of a plurality of specialized tools.

12 Claims, 2 Drawing Sheets

PULLING TOOL

CROSS-REFERENCE TO RELATED APPLICATION

The present U.S. Non-Provisional patent application cross-references and claims priority and benefit as a continuation of U.S. Design patent application Ser. No. 29/254,444, filed Feb. 23, 2006, entitled "Non-Threaded Fastener Pulling Tool with Saw Wrench, Nail Pick, and Bottle Opener Combination," which is hereby incorporated by reference in its entirety.

TECHNICAL FIELD

The present disclosure relates generally to hand tools, and, more particularly, to construction tools, such as a pulling tool, or the like.

BACKGROUND OF THE INVENTION

Construction work typically requires the use of a plurality of tools, including hand tools and electric tools. Necessary hand tools usually include tools designed for joining particular materials together, as well as tools designed to assist in breaking apart construction materials, such as when improper installation or measurement error is detected. Electric tools, such as saws, drills, and the like, further frequently necessitate the utilization of additional tools, such as chucks, for adjustment, adaptation, and exchange of component parts during a project. Thus, each construction worker is often faced with a myriad of tools to transport.

Transport of such a collection of tools to a jobsite is a dubious task in and of itself, but maintaining mobility of such a number of tools and exchanging between tools while working is disadvantageously time and energy consuming. Further disadvantages can be realized directly by the workforce. That is, in addition to time and material costs, worker performance can be compromised by premature exhaustion as a result of repeatedly expending energy exchanging between a plurality of heavy tools, and necessarily transporting those tools about a work site.

Thus, it is clear that there is an unmet need for a construction tool that advantageously provides a plurality of on-board tools to assist in user accomplishment of a variety of tasks at a given job site, coincidentally maximizing workforce energy and efficiency.

BRIEF SUMMARY OF THE INVENTION

Briefly described, in an exemplary embodiment, the pulling tool of the present disclosure overcomes the above-mentioned disadvantages and meets the recognized need for such a tool by providing a non-threaded fastener pulling tool having a saw wrench, nail pick, and bottle opener.

More specifically, the exemplary pulling tool of the present disclosure includes a generally elongated handle portion with a lever pulling head at a first end of the handle portion, and a nail pick at a second end of the handle portion. The handle portion preferably includes generally broad, flat side-wall surfaces for stability and strength, wherein at least one of which is adapted to receive a plurality of on-board tools. The handle portion may further include generally narrow edge surfaces, at least one of which may be adapted with grip-enhancing features. Thus, the handle portion is generally formed as a sturdy bar, grippable for ease of use in a plurality of positions relative to the workpiece. The handle portion may also include a comfortable grip operable therewith to provide a comfortable gripping surface by which a user may grasp the tool, while maintaining strength of hold, wherein such a comfort grip may be provided in addition to or in lieu of the on-board grip-enhancing features.

The nail pick portion is generally a slightly angular extension of the handle and has a preferably broad front and rearward surface, corresponding to the broad, flat side-wall surfaces of the handle, to facilitate effective delivery of prying forces, such as to withdraw nails from a workpiece. The lever pulling head, or non-threaded fastener puller, similarly has a broad front and rearward surface, however, the broadened tine or claw of the pulling surfaces preferably extends dimensionally and angularly from the heel, which corresponds to the narrow edge surfaces of the handle. This facilitates effective delivery of lever action, such as to pull nails firmly embedded in a workpiece. For example, while removal of an improperly positioned nail may require a simple nail pick, some instances of fully seated nails may necessitate the use of a pulling lever claw for beneficial fulcrum action.

The generally broad, flat side-wall surface of the handle portion proximate the heel of the lever pulling head may preferably include additional useful tools, such as a saw wrench, a bottle opener, and an open wrench. The optional saw wrench is preferably disposed as a functional feature extending from the handle side-wall surface, with an outer edge angularly disposed relative to the plane of the handle side-wall. Such an orientation facilitates access to the recess wrench feature while also enabling a user to retain grippable positioning of the tool relative to the workpiece. That is, the configuration is preferred for use with a circular saw, wherein a blade fastener may be engaged by the saw wrench, with the handle of the tool extending away from the saw blade surface due to the angular outer edge of the saw wrench such that the user may grip the handle for application of force to loosen and remove the fastener without fear of inadvertent engagement with the saw blade. For example, the saw wrench may extend to an angle approximately equal to 60 degrees and preferably greater than 45 degrees.

The optional bottle opener may preferably be disposed proximate the saw wrench, on the handle side-wall, in order to facilitate insertion of a capped bottle according to the traditional functional configuration of a bottle opener, wherein pulling forces applied to the handle of the tool can easily and effectively remove a bottle cap. Preferably abutting the bottle opener, the optional open wrench may extend outwardly from the handle side-wall, preferably with a length of extension greater than that of the bottle opener or saw wrench relative to the side-wall. The wrench is preferably open such that a narrow article could be inserted therewithin via the open side. The outer edge of the open wrench is preferably generally flat, with the elongated nature of the preferred wrench socket facilitating loosening of even deep set bolts with application of the handle leverage.

Accordingly, one feature and advantage of the tool of the present disclosure is its ability to provide a strong handle portion having surfaces adapted to grip comfort and easy application of force during a plurality of tool uses.

Another feature and advantage of the tool of the present invention is its ability to provide grip-enhancing recesses that facilitate grasping of the edges of the device.

Another feature and advantage of the tool of the present disclosure is its ability to provide a durable pulling tool capable of delivering leveraged forces while providing a beneficial weight distribution and balance for ease of use.

Yet another feature and advantage of the tool of the present disclosure is its ability to provide a plurality of on-board tools to efficiently assist in the accomplishment of a plurality of construction-related tasks.

Still another feature and advantage of the tool of the present disclosure is its ability to perform as a balanced lever for transfer of forces.

Yet still another feature and advantage of the tool of the present disclosure is its ability to provide a bottle opener for opening bottles.

Still yet another feature and advantage of the tool of the present disclosure is its ability to eliminate the need for the transport of a plurality of specialized tools to a work site.

Another feature and advantage of the tool of the present disclosure is its ability to provide for user performance of a variety of different work efforts, according to the nature of the job component needs.

Still another feature and advantage of the tool of the present disclosure is its ability to provide a nail picking region to offer assistance with nail removal.

And yet still another feature and advantage of the tool of the present disclosure is its ability to provide a non-threaded fastener puller that can leverage forces for maximum work.

Another feature and advantage of the tool of the present disclosure is its ability to provide a saw wrench that can facilitate the quick removal and secure replacement of circular saw blades.

Still another feature and advantage of the tool of the present disclosure is its ability to provide am open wrench that can facilitate the loosening and/or tightening of even deeply recessed bolts.

These and other features and advantages of the tool of the present disclosure will become more apparent to those ordinarily skilled in the art after reading the following Detailed Description of the Invention and Claims in light of the accompanying drawing Figures.

BRIEF DESCRIPTION OF THE DRAWINGS

Accordingly, the present disclosure will be understood best through consideration of, and with reference to, the following drawings, viewed in conjunction with the Detailed Description of the Invention referring thereto, in which like reference numbers throughout the various drawings designate like structure, and in which.

Figure 1:
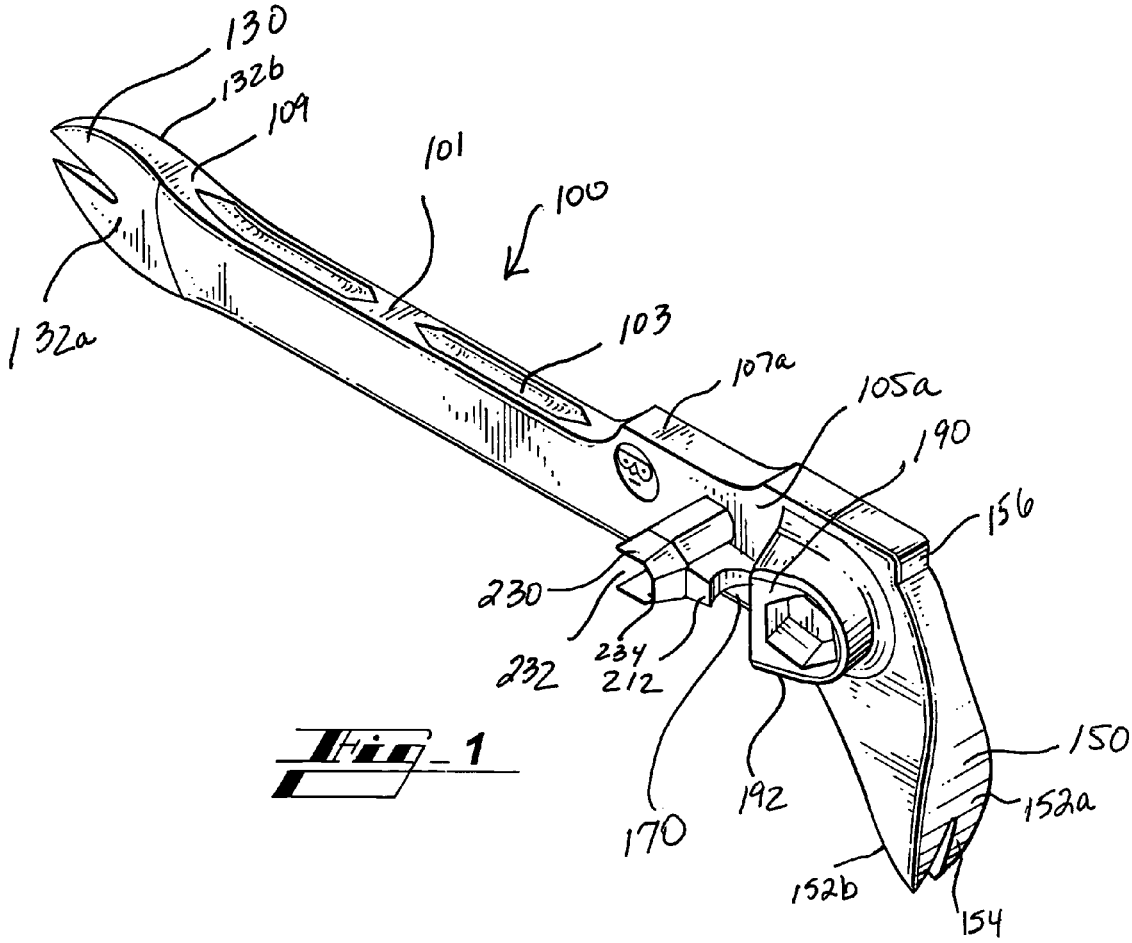
FIG. 1 is a perspective view of the pulling tool of the present disclosure, according to a preferred embodiment.

It is to be noted that the drawings presented are intended solely for the purpose of illustration and that they are, therefore, neither desired nor intended to limit the scope of the disclosure to any or all of the exact details of construction shown, except insofar as they may be deemed essential to the claimed invention.

DETAILED DESCRIPTION OF THE INVENTION

In describing exemplary embodiments of the hammer of the present disclosure illustrated in the drawings, specific terminology is employed for the sake of clarity. The claimed invention, however, is not intended to be limited to the specific terminology so selected, and it is to be understood that each specific element includes all technical equivalents that operate in a similar manner to accomplish a similar purpose.

Figure 2:
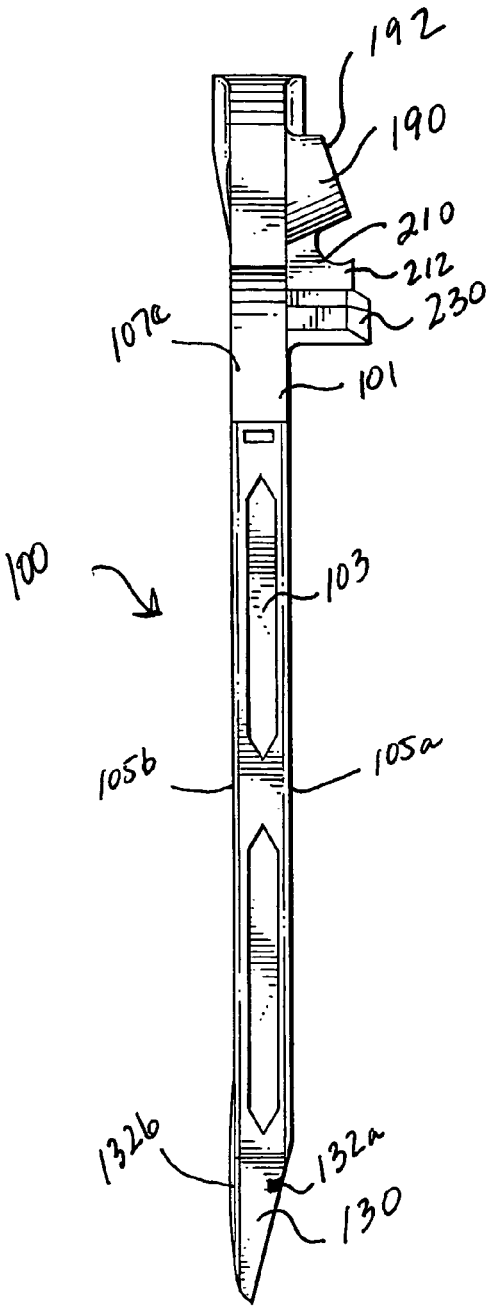
FIG. 2 is a top view of the pulling tool of FIG. 1.
Figure 3:
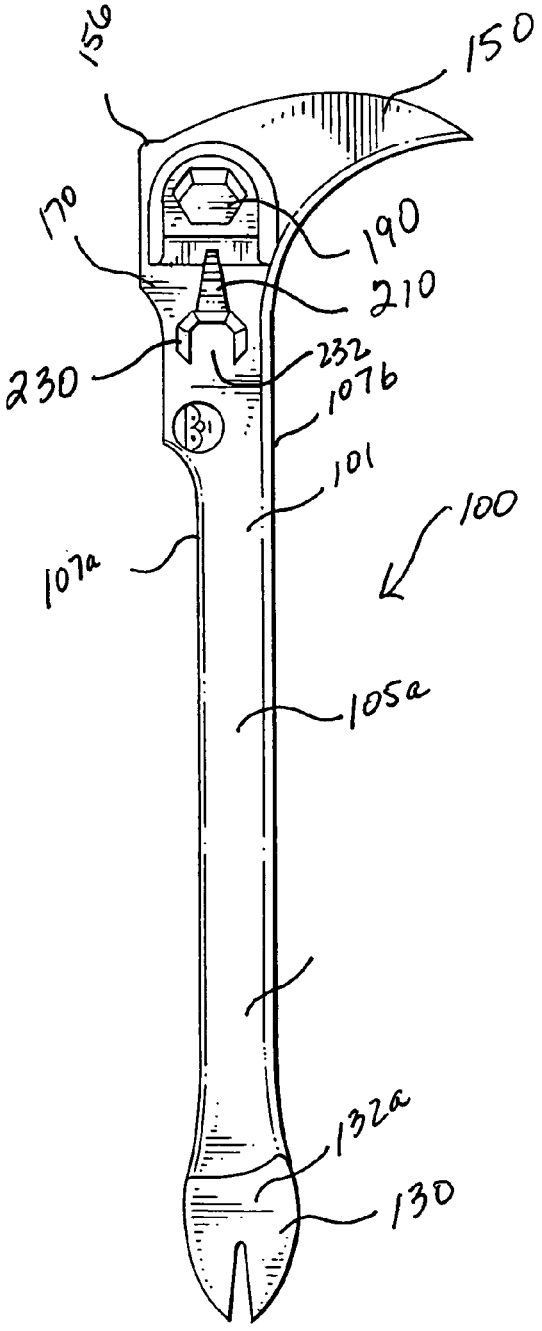
FIG. 3 is a side view of the pulling tool of FIG. 1.

In that form of the pulling tool of the present disclosure chosen for purposes of illustration, FIGS. 1-3 show tool 100 including handle 101 and grip features 103. Handle 101 is preferably formed from a suitable metal, composite, or synthetic material, or the like, defining nail pick tool 130 and levered pulling head 150, and may include a comfort grip member (not shown) installed thereon. The comfort grip member may be formed from natural or synthetic rubber, plastic, composite, form, combinations, or the like, and may be resilient and/or sculptured or contoured to provide a comfortable and secure grasping surface.

Handle 101 is preferably configured to provide durability and/or strength while reducing a total mass thereof and while providing a beneficial balance or distribution of mass, preferably defining a bar shape, with broad sidewall surfaces 105*a*, 105*b* and narrow edge surfaces 107*a*, 107*b*. Preferably, grip features 103 are defined in narrow edge surface 107*a*, disposed in a balanced arrangement, and recessed relative to narrow edge surface 107*a*. The preferred shape for grip features 103 is that of an elongate hexagonal shape, wherein the length of each recess facilitates reception of one or more fingertips of a user therein for grip enhancement. As noted, handle 101 may also include a comfortable grip operable therewith to provide a comfortable and secure gripping surface by which a user may grasp the tool.

Nail pick tool 130 is preferably included at a distal end 109 of handle 101, and is preferably wedge-shaped, as best seen in FIG. 2, to facilitate effective delivery of prying forces. Pick surface 132*a* is preferably angularly related to sidewall surface 105*a*, and pick surface 105*b* is preferably coplanar with sidewall surface 105*b*. This configuration facilitates the pulling action of nail pick tool 130.

The non-threaded fastener puller, or lever pulling head, 150 preferably has broad front and rearward surfaces 152*a*, 152*b*. The broadened tine or claw 154 of pulling surfaces 152*a*, 152*b* preferably extends dimensionally and angularly from heel 156, which may extend from narrow edge surface 107*a* of handle 101. This facilitates effective delivery of lever action, such as to pull nails firmly embedded in a workpiece. Non-threaded fastener puller 150 may be thus adapted to pry articles, such as nails, via application of force to handle 101.

Tool zone 170 of broad side-wall surface 105*a* of handle 101 is preferably provided proximate heel 156 of lever pulling head 150 and may include a variety of additional useful tools. In one preferred embodiment, tool zone 170 may include saw wrench 190, bottle opener 210, and open wrench 230. Saw wrench 190 is preferably disposed as a functional feature extending from side-wall surface 105*a*, with outer edge 192 angularly disposed relative to the plane of side-wall 105*a*. Once again, this preferred angular outer edge 192 facilitates positioning of puller 100 in a default extension position, wherein second end 109 of handle 101 is outwardly and angularly extended relative to the saw work surface upon which saw wrench 190 is being utilized. In such manner, a user may be able to retain a safe grip at a distance removed from the blade edge during circular saw blade removal and installation. The preferred angular disposition is about 60 degrees, and preferably greater than 45 degrees.

Optional bottle opener 210 may be positioned proximate saw wrench 190, on handle side-wall 105*a*. The preferred traditional configuration of bottle opener 210 includes cap lip 212, wherein outer edge 192 of saw wrench 190 performs as a fulcrum for bottle opener leverage. Preferably abutting bottle opener 210, and opposingly positioned to saw wrench 190, optional open wrench 230 may also extend outwardly from handle side-wall 105*a*, preferably with a length of extension greater than that of bottle opener 210 or saw wrench 190 relative to side-wall 105*a*. Preferably, opening 232 is defined in open wrench 230 in order that a nut may be selectively slidably inserted therethrough, rather than from outer end 234. The open wrench is preferably approximately octagonal in shape wherein three sides of the octagon are missing, thereby providing two parallel sides of the octagon proximate the opening for gripping of bolts and the like. The extended socket of the open wrench may be generally narrowed in the top portion to provide a sharp edge along the top rim of the wrench.

Having thus described exemplary embodiments of the present invention, it should be noted by those skilled in the art that the within disclosures are exemplary only and that various other alternatives, adaptations, and modifications may be made within the scope and spirit of the present invention. Accordingly, the present invention is not limited to the specific embodiments as illustrated herein, but is only limited by the following claims.

What is claimed is at least:

1. A tool comprising:

a handle portion adapted to be gripped by a user wherein the handle portion further comprises a sidewall surface and an edge surface wherein the sidewall surface is broader than the edge surface; and a tool zone having a plurality of structures operable with said handle portion and adapted to perform at least one function, wherein said plurality of structures comprises at least one of a nail pick and a lever pulling head wherein said plurality of structures further comprises a saw wrench tool and wherein said saw wrench tool is a hexagonal-shaped recess disposed proximate a heel of said lever pulling head.

2. The tool of claim 1, wherein said saw wrench tool further comprises an outer edge, wherein said outer edge is angularly disposed relative to an outer surface of said handle.

3. A tool comprising:

a handle portion adapted to be gripped by a user wherein the handle portion further comprises a sidewall surface and an edge surface wherein the sidewall surface is broader than the edge surface; and a tool zone having a plurality of structures operable with said handle portion and adapted to perform at least one function, wherein said plurality of structures comprises at least one of a nail pick and a lever pulling head further comprising a bottle opener wherein said bottle opener is formed from a cap lip in the sidewall.

4. A tool comprising:

a handle portion adapted to be gripped by a user wherein the handle portion further comprises a sidewall surface and an edge surface wherein the sidewall surface is broader than the edge surface; and a tool zone having a plurality of structures operable with said handle portion and adapted to perform at least one function, wherein said plurality of structures comprises at least one of a nail pick and a lever pulling head further comprising an open wrench, wherein said open wrench further comprises a peripheral wall generally octagonal in shape, wherein three sides of the octagon are missing to provide the opening of the wrench.

5. A tool comprising:

a handle portion adapted to be gripped by a user wherein the handle portion further comprises a sidewall surface and an edge surface wherein the sidewall surface is broader than the edge surface; and a tool zone having a plurality of structures operable with said handle portion and adapted to perform at least one function, wherein said plurality of structures comprises at least one of a nail pick and a lever pulling head wherein said handle has at least one grip-enhancing feature wherein the grip-enhancing feature is defined in the edge surface.

6. The tool of claim 5, wherein said grip-enhancing feature is disposed in an edge of said handle as an elongated hexagonally shaped recess.

7. A device for performing a plurality of construction-related functions comprising:

a body having a handle portion wherein the handle portion further comprises a sidewall surface and an edge surface wherein the sidewall surface is broader than the edge surface and a first and second end;

a nail pick disposed on said first end;

a non-threaded fastener puller disposed on said second end;

a bottle opener disposed on said sidewall surface of handle portion;

a saw wrench disposed on said sidewall surface of handle portion, proximate said bottle opener; and an open wrench disposed on said sidewall surface of handle portion, proximate said bottle opener.

8. The device of claim 7, wherein said saw wrench tool further comprises an outer edge, wherein said outer edge is angularly disposed relative to an outer surface of said handle.

9. The device of claim 7, wherein said open wrench further comprises a peripheral wall generally octagonal in shape, wherein three sides of the octagon are missing to provide the opening of the wrench.

10. A multi-purpose construction tool, comprising:

an elongated handle wherein a handle portion further comprises a sidewall surface and an edge surface wherein the sidewall surface is broader than the edge surface;

a wedge tool disposed proximate a distal end of said elongated handle; and a lever head tool disposed proximate a proximal end of said elongated handle;

wherein said elongated handle further comprises a saw wrench tool; and wherein said saw wrench tool is defined by a hexagonally-shaped recess and a peripheral wall, and wherein a first edge of said peripheral wall adjoins said handle, and a second edge of said peripheral wall is angularly disposed relative to the plane of said handle.

11. A multi-purpose construction tool, comprising:

an elongated handle wherein a handle portion further comprises a sidewall surface and an edge surface wherein the sidewall surface is broader than the edge surface;

a wedge tool disposed proximate a distal end of said elongated handle; and a lever head tool disposed proximate a proximal end of said elongated handle wherein said elongated handle further comprises a bottle opener.

12. A multi-purpose construction tool, comprising:

an elongated handle wherein a handle portion further comprises a sidewall surface and an edge surface wherein the sidewall surface is broader than the edge surface;

a wedge tool disposed proximate a distal end of said elongated handle; and a lever head tool disposed proximate a proximal end of said elongated handle wherein said elongated handle further comprises an open wrench and wherein said open wrench further comprises a peripheral wall generally octagonal in shape, wherein three sides of the octagon are missing to provide the opening of the wrench.

* * * * *